US006203016B1

(12) United States Patent
Frommer

(10) Patent No.: US 6,203,016 B1
(45) Date of Patent: Mar. 20, 2001

(54) METHOD OF PLAYING CHESS

(76) Inventor: Dror Frommer, 42 Glendale Ave., Livingston, NJ (US) 07039

( * ) Notice: Subject to any disclaimer, the term of this patent is extended or adjusted under 35 U.S.C. 154(b) by 0 days.

(21) Appl. No.: 09/317,466

(22) Filed: May 24, 1999

(51) Int. Cl.[7] ..... A63F 3/02

(52) U.S. Cl. ..... 273/260; 273/236; 273/255; 273/262; 273/242

(58) Field of Search ..... 273/255, 236, 273/242, 260, 261, 262

(56) References Cited

U.S. PATENT DOCUMENTS 3,565,436 * 2/1971 Opmeer .
4,003,580 * 1/1977 Haffey .
4,093,236 * 6/1978 Hoffa .
4,280,704 * 7/1981 Massimei .
5,171,018 * 12/1992 Zhang .

OTHER PUBLICATIONS

Screen Chess by "new rules of classic games" published by John, Wiley and sons 1992.*

* cited by examiner

*Primary Examiner*—Sebastiano Passaniti
*Assistant Examiner*—V Mendiratta
(74) *Attorney, Agent, or Firm*—Myron Amer PC

(57) ABSTRACT

A method of playing chess in which eventually all chess moves are played out on a chess board in full view, but some of these moves are previously recorded out-of-view, so that the playing out of these recorded moves adds surprise to the play and an element of chance to the outcome of the chess game.

1 Claim, 1 Drawing Sheet

METHOD OF PLAYING CHESS

The present invention relates generally to a method of playing a modified chess game, and more particularly to a modification which introduces an element of chance in the game play to complement the playing skill of the chess players, to the end of contributing to the play value of the chess game.

EXAMPLES OF THE PRIOR ART

The patent literature documents efforts to modify the well known prescribed way of playing chess to add more interest to the players, such patent literature being exemplified by U.S. Pat. No. 5,536,014 issued to Andras Serfozo for "Modified Chess Game" on Jul. 16, 1996, and U.S. Pat. No. 5,735,523 issued to Patrick D.C. Floriglio for "Method of Playing A Modified Chess Game" on Apr. 7, 1998, to mention but a few.

In the above and all other known patents, the modification challenges the playing skill of the chess player. Thus, in the '014 patent the squares of the chess board are marked with indicia to convert traditional moves into bonus moves, and it is left to the skill of the player to use to advantage this modification. To the same end, in the '523 patent, two rows of an additional 16 squares are added to the traditional 64 squares and also a new chess piece with a prescribed new playing movement, and these modifications and its effect on the outcome of the chess game are left to the skill of the player.

With players of comparative playing skill, the prior art modifications noted add only nominal play value to playing chess because in time the skill of the players will adapt to the modifications, and the outcome will depend again mainly on the comparative playing skill of the players.

Broadly, it is an object of the present invention to provide a modified method of playing chess overcoming the foregoing and other shortcomings of the prior art.

More particularly, it is an object to incorporate chess moves in the play of the chess game that at the time decided upon are not known as to their effect on the outcome of the game, such that an element of chance, i.e., whether the moves are or are not effective in removing the opponent's chess pieces from play, is a factor in the play which significantly contributes to the play value of the chess game, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
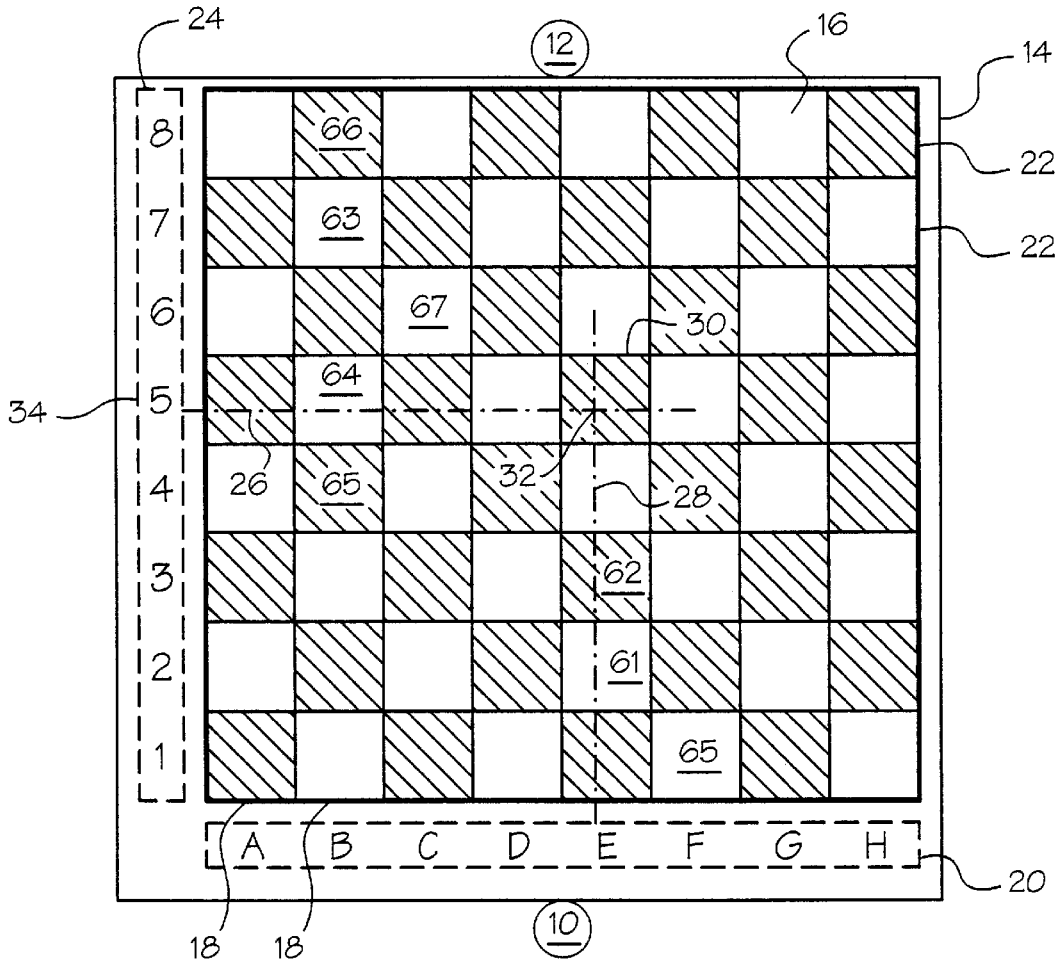
FIG. 1 illustrates, in plan perspective, components used in playing chess in accordance with the method of the present invention.

Illustrated in FIG. 1 are a first chess player 10 and a second chess player 12 in facing relation to each other over a chess board 14 having a playing surface 16 delineated by eight horizontally oriented columns, individually and collectively designated 18, that are associated with letters in alphabetical sequence, as at 20, in this case using the letters "A", "B", "C", "D", "E", "F", "G", and "H", and also delineated by eight vertically oriented columns, also individually and collectively designated 22, that are numbered sequentially, as at 24, in this case using the numbers "1", "2", "3", "4", "5", "6", "7", and "8", wherein the columns 18 and 22 intersect on the playing surface 16 so that as demonstrated by the reference lines 26 and 28 at the intersect location 32 there is delimited a playing surface square 30, the location of which is readily determined by a combination letter/number designation 34, in this case being the designation "E5" out of the possible sixty-four possible designations. During play, the square 30 and other squares are adapted to be occupied by a chess piece.

Figure 2:
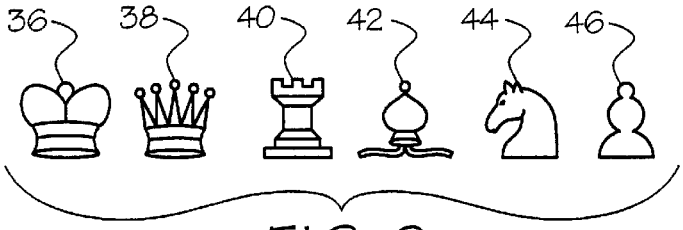
FIG. 2 is an elevational view of the chess pieces used.
Figure 3:
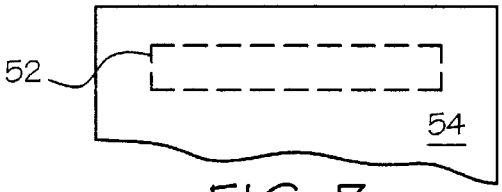
FIG. 3 is a plan view illustrating a step in the practice of the method.

As best illustrated in FIG. 2 and, as generally known, the chess pieces used are chess piece 36, known as a "King" of which there is one, chess piece 38, known as a "Queen" of which there is one, chess piece 40, known as a "rook" of which there are two, chess piece 42 known as a "bishop" of which there are two, chess piece 44, known as a "knight" of which there are two, and chess piece 46, known as a "pawn", of which there are eight.

Assuming that by mutual agreement player 10 starts a playing sequence, either starting the chess game or after a specified number of moves allowing positions of the chess pieces to be established according to playing strategies, this player will record out of the view of player 12 a chess move, as noted at 52 on paper sheet 54 using a selected chess piece moved to a selected letter/number designated playing surface square, in this case the "pawn" chess piece 46 to playing surface square 62, from a starting playing surface square 61, the recording of which will be noted as "pawn from E2 to E3".

The play then switches to player 12 who will record out of the view of player 10 a chess move, as noted at 52 on his paper sheet 54, using a selected chess piece, in this case the "pawn" chess piece 46 to a selected playing surface square 64 from a starting playing surface square 63, the recording of which will be noted as "pawn from B7 to B5".

Player 10 next executes in clear view of player 12 the previously recorded chess move, by moving pawn 46 to playing square 62.

Player 10 next records out of the view of player 12 a second chess move, as at 52 on sheet 54, using another selected chess piece moved to a selected number/letter designated playing surface square, in this case the bishop piece 42 to playing surface square 64, from a starting playing surface square 65, the recording of which will be noted as "Bishop from F1 to B5".

Player 12 next executes in clear view of player 10 the previously recorded chess move, by moving pawn 46 to playing square 64.

Player 12 next records out of the view of player 10 a second chess move, as at 52 on sheet 54, using another selected chess piece moved to a selected number/letter designated playing surface square, in this case the pawn piece 46 to playing surface square 65, from a starting playing surface square 64, the recording of which will be noted as "pawn from B5 to B4", having no knowledge of the nature of player 10's last move, it being understood that the rules of chess which govern play prevent this pawn move. Thus, forcing player 12 to choose another move, which is considered a legal move by the governing chess rules.

Returning to the sequence of play, player 12 next records out of the view of player 10 a second chess move, as at 52 on sheet 54, using another selected chess piece moved to a selected number/letter designated playing surface square, in this case the "knight" piece 44 to playing surface square 67, from a starting playing surface square 66, the recording of which will be noted as "knight from B8 to C6".

The sequence of play is then repeated, starting with execution of a previously recorded chess move by player 10, recording a chess move by player 10 out of view of player 12, the execution by player 12 of a previously recorded chess move, and lastly the recording of a chess move by player 12 out of view of player 10. Thus, at each point of play, each of the players in one move behind the other, which by happenstance can result in a double occupancy of a playing square which, as understood, is a circumstance which dictates the removal from play of the chess piece first to occupy the playing square. An example of this happenstance is the double occupancy of playing square 64.

Thus, while play to a "checkmate" or a draw is still achieved perhaps primarily by the playing skill of the player, it is also achieved by the luck of the happenstance of playing out the recorded chess moves of the players.

While the apparatus for practicing the within inventive method, as well as said method herein shown and disclosed in detail is fully capable of attaining the objects and providing the advantages hereinbefore stated, it is to be understood that it is merely illustrative of a presently preferred embodiment of the invention and that no limitations are intended to the detail of construction or design herein shown other than as defined in the appended claims.

What is claimed is:

1. A method of playing chess by opposing first and second chess players comprising at least the steps of (1) using a game board having a playing surface, (2) delineating said game board surface into uniform sized eight rows of vertically oriented columns and eight rows of horizontally oriented columns in intersecting relation with each other so as to delimit at each location of intersection on said playing surface a square adapted to be occupied by a chess piece, (3) identifying each playing surface square with a combination letter and Dumber designation, (4) recording a first chess move by said first chess player out of the view of said second chess player of a selected chess piece to a designated selected playing surface square, (5) recording a first chess move by said second chess player out of the view of said first chess player of a selected chess piece to a designated selected playing surface square, (6) making, as previously recorded in step (4) a chess move by said first chess player in fall view of said second chess player of a selected chess piece to a selected playing surface square, (7) making a chess move by said second chess player as previously recorded in step (5) in full view of said first chess player of a selected chess piece to a selected playing surface square, (8) recording a second chess move by said second chess player out of the view of said first chess player of a selected chess niece to a designated selected playing surface square, (9) recording a second chess move by said first chess player out of the view of said second chess player of a selected chess piece to a designated selected playing surface square, (10) making as previously recorded in step (8) a chess move by said second chess player in full view of said first chess player of a selected chess piece to a selected playing surface square (11) making a chess move by said first chess player as previously recorded in step (9) in full view of sad second chess player of a selected chess piece to a selected playing surface square, and (12) removing from play one of any two chess pieces occupying the same playing surface square, whereby a coincidence of double occupancy of a playing surface square contributes an element of chance to the playing skill of the chess players.

* * * * *